US009845938B1

(12) United States Patent
Kaye et al.

(10) Patent No.: US 9,845,938 B1
(45) Date of Patent: Dec. 19, 2017

(54) SHOCK ABSORBING FLASHLIGHT

(71) Applicant: LB Marketing Inc., Alpharetta, GA (US)

(72) Inventors: Douglas Kaye, Alpharetta, GA (US); Andrea Hoffmeier, Alpharetta, GA (US); John Oliver, Gulf Breeze, FL (US)

( * ) Notice: Subject to any disclaimer, the term of this patent is extended or adjusted under 35 U.S.C. 154(b) by 55 days.

(21) Appl. No.: 15/074,095

(22) Filed: Mar. 18, 2016

Related U.S. Application Data

(60) Provisional application No. 62/140,052, filed on Mar. 30, 2015.

(51) Int. Cl.
*F21V 15/04* (2006.01)
*F21L 4/00* (2006.01)
*F21V 29/77* (2015.01)

(52) U.S. Cl.
CPC ..... *F21V 15/04* (2013.01); *F21L 4/005* (2013.01); *F21V 29/77* (2015.01)

(58) Field of Classification Search
CPC ..... F21V 15/04; F21V 29/77; F21L 4/005
USPC ..... 362/202
See application file for complete search history.

(56) References Cited

U.S. PATENT DOCUMENTS 2,253,952 A 8/1941 Desimone
3,898,450 A 8/1975 Kilby
5,165,782 A 11/1992 Maglica et al.
5,267,131 A 11/1993 Anthony et al.
5,860,730 A 1/1999 Hesprich
5,957,567 A * 9/1999 Kish ..... F21L 4/005 362/202
6,467,930 B1 10/2002 Frick
6,629,767 B2 2/2003 Osiecki et al.
6,530,564 B1 * 3/2003 Julien ..... A43B 13/186 267/147
6,923,553 B2 8/2005 Mackin
7,073,921 B2 7/2006 Chen
7,641,358 B1 * 1/2010 Smith ..... F21L 4/08 315/307
2005/0017077 A1 * 1/2005 Bhatia ..... G06K 7/1098 235/462.45
2009/0278383 A1 * 11/2009 Lindmark ..... B60R 21/34 296/187.04
2014/0268712 A1 * 9/2014 Kamm ..... F21L 4/005 362/202

* cited by examiner

*Primary Examiner* — Toan Ly
(74) *Attorney, Agent, or Firm* — Lawrence J. Shurupoff

(57) ABSTRACT

A flashlight is protected from damage due to shock such as occurs when a flashlight is dropped, crushed or otherwise physically abused. A plastic molding can be attached to either the front or rear portion of a flashlight or to both portions to resiliently absorb shock forces. A series of thin fins projects axially outwardly from the molding to resiliently deform upon impact so as to absorb shock and distribute the shock around the ends of the flashlight and to reduce stress concentrations around the ends of the flashlight. A series of axially-extending and radially-extending ribs further protects the flashlight from axially and radially-directed shock forces and further absorb shock forces. An optional safety crush or clearance zone can be provided between each shock absorber and the flashlight.

15 Claims, 8 Drawing Sheets

SHOCK ABSORBING FLASHLIGHT

BACKGROUND AND SUMMARY

When a flashlight is dropped, the resulting abrupt impact with a hard surface can damage both the external and internal parts of the flashlight. That is, the impulse applied to a flashlight upon impact can break the lens, light source, light switch and casing, as well as damage the batteries and internal electrical circuits. While some flashlights have been provided with resilient covers, none is known to be able to withstand the impact from a fall of up to 100 feet.

This disclosure is directed to a shock absorbing system for a flashlight and to a flashlight fitted with the shock absorbing system that can withstand the impact from a fall of up to 100 feet. Potentially damaging impacts are absorbed from all directions with a shock absorbing system that includes an external shock absorber on both the head or front portion of a flashlight and on the tail or rear portion of a flashlight. Each external shock absorber includes a series of axially-extending flexible fins which are designed to resiliently flex and bend upon impact so as to reduce impact impulses and provide a more gradual deceleration of the flashlight. The flexing and bending of the fins dampens the impact by providing a predetermined distance over which the fins can deform while absorbing, distributing and dissipating the kinetic energy of a falling flashlight.

This absorption of energy by resilient deformation of the fins can be augmented with the provision of an optional axial and radial clearance zone around each end of a flashlight. These open clearance spaces allow for additional deflection of the fins and provide a space through which impacts and impulse forces are absorbed by additional resilient deformation of a series of circumferentially-spaced-apart fins. In effect, an annular "safety zone" or "crumple zone" is formed around the front crown of a flashlight as well as around the rear tail cap of a flashlight. That is, in one embodiment, before any contact occurs between the fins and the flashlight, the fins resiliently deflect over a predetermined distance so as to absorb shock forces. In this manner, reduced shock forces are transferred to the flashlight.

Additional shock absorbing protection is provided on both the front and rear shock absorbers in the form of axially-extending resilient ribs which protrude radially outwardly away from the body of a flashlight. In this manner, the ribs make first contact with any impact surface before any contact is made against the underlying flashlight body or casing. In one embodiment, the ribs can extend axially into each respective fin so as to provide supplemental support to each fin and to further distribute impact forces over a larger surface area around the flashlight casing.

In the case of the front shock absorber, the bottom of the fins are formed with radially-inwardly extending engagement surfaces which overlie the leading circular edge of the flashlight crown. The engagement surfaces can be homogeneously molded with a front annular flange having a bottom wall axially spaced over the edge of the flashlight crown. In this manner, impact forces are first absorbed by deformation of the fins and then reduced forces are distributed circumferentially around the flashlight crown by the front annular flange and a cylindrical front side band which interconnects the fins and spaces the front shock absorber from the flashlight crown.

The front annular flange and the cylindrical front side band tend to distribute impact forces circumferentially around the flashlight crown so as to reduce localized stresses adjacent the point of first contact between the front of the flashlight and the ground or any other hard impact surface. This cushioning is effective for absorbing both axial and radial impact forces applied to the front shock absorber. An annular resilient rubber or elastomeric cap can be provided between the bottom of the front fins and the top edge of the flashlight crown to further absorb and distribute impact forces around the flashlight crown.

Impact forces received by the fins and circumferentially distributed by the front annular flange and the front side band are further absorbed by the axially-extending ribs which can be molded homogeneously with the front fins, front annular flange and front side band. The ribs can extend radially outwardly from the outer surface of the front side band and extend axially from the front fins to a rear annular or cylindrical band which surrounds and grips a rear portion of the flashlight head portion. The rear band anchors the front shock absorber on the flashlight crown.

With the ribs interconnecting the front and rear bands, forces received by the fins are transferred to the front side band and also to the rear band via the axially-extending ribs to further dissipate shock throughout the front shock absorber. That is, the rear band can circumferentially grip the flashlight body and further distribute forces to a portion of the flashlight axially spaced rearwardly from the front side band.

Because the ribs extend radially outwardly from the flashlight body, they protect the underlying side walls of the flashlight body from the shocks applied radially to the flashlight. The ribs can be dimensioned to either extend in contact with the underlying flashlight body and/or overlie the underlying flashlight body with a small clearance. In one embodiment, a clearance space between the ribs and the flashlight body allows the ribs to flex radially inwardly and absorb shock prior to transferring radial shock forces to the flashlight body.

The rear band is designed to radially grip and clamp around the rear crown portion of a flashlight. This can be achieved by forming the front shock absorber in two generally semi-cylindrical half shells. The half shells can be clamped together with any suitable fasteners such as screws, rivets or with an integrally formed snap fit connection. A tongue and groove connection can also be molded into the contacting surfaces of each half shell to provide an axially-sliding friction connection therebetween. Adhesive bonding can also be used.

Modern high intensity flashlights can generate a significant amount of heat around the flashlight crown which houses one or more incandescent bulbs or one or more light emitting diodes (LEDs). In order to allow for the efficient transfer of heat from the flashlight crown to ambient, the ribs are spaced apart with large open spaces between them to allow direct contact between the flashlight crown and the surrounding ambient air. Such open spaces are not as necessary around the cooler tail end of the flashlight.

The rear shock absorber has a structure similar to the front shock absorber. A series of rear fins projects axially rearwardly from the rear shock absorber to absorb both axial and radial impact forces applied to the tail portion of a flashlight. The rear fins are supported on an end cap formed with a cylindrical side wall and an annular end wall. The end wall extends radially inwardly from the side wall to a central axially-raised circular wall surrounding a circular opening. An elastic or rubber thimble cap serving as a switch cover and switch actuator extends rearwardly through the circular opening from within the end cap for actuating an on-off switch mounted on the tail of the flashlight.

As with the front shock absorber, the rear shock absorber is provided with a series of circumferentially-spaced-apart radially-projecting ribs which extend along the cylindrical side wall of the rear shock absorber. An axial and radial clearance fit can be provided between the end cap and the rear or tail portion of a flashlight. The ribs can extend from the fins as described above.

The rear shock absorber can also be mounted to the tail of a flashlight with a simple friction fit or with a separate locking ring. The locking ring can be formed as a frusto-conical or axially tapered band which encircles and radially grips the tail of a flashlight. Axially-extending locking tabs are formed on the locking ring to engage the inner end of the cylindrical side wall of the end cap with one or more snap fit connections. External ribs can be formed on the locking ring to match and align with the ribs on the end cap. Axial and radial clearances can be maintained between the rear shock absorber and the rear portion of the flashlight to provide a "safety zone" similar to that provided around the front portion of the flashlight.

DESCRIPTION OF REPRESENTATIVE EMBODIMENTS

Figure 1:
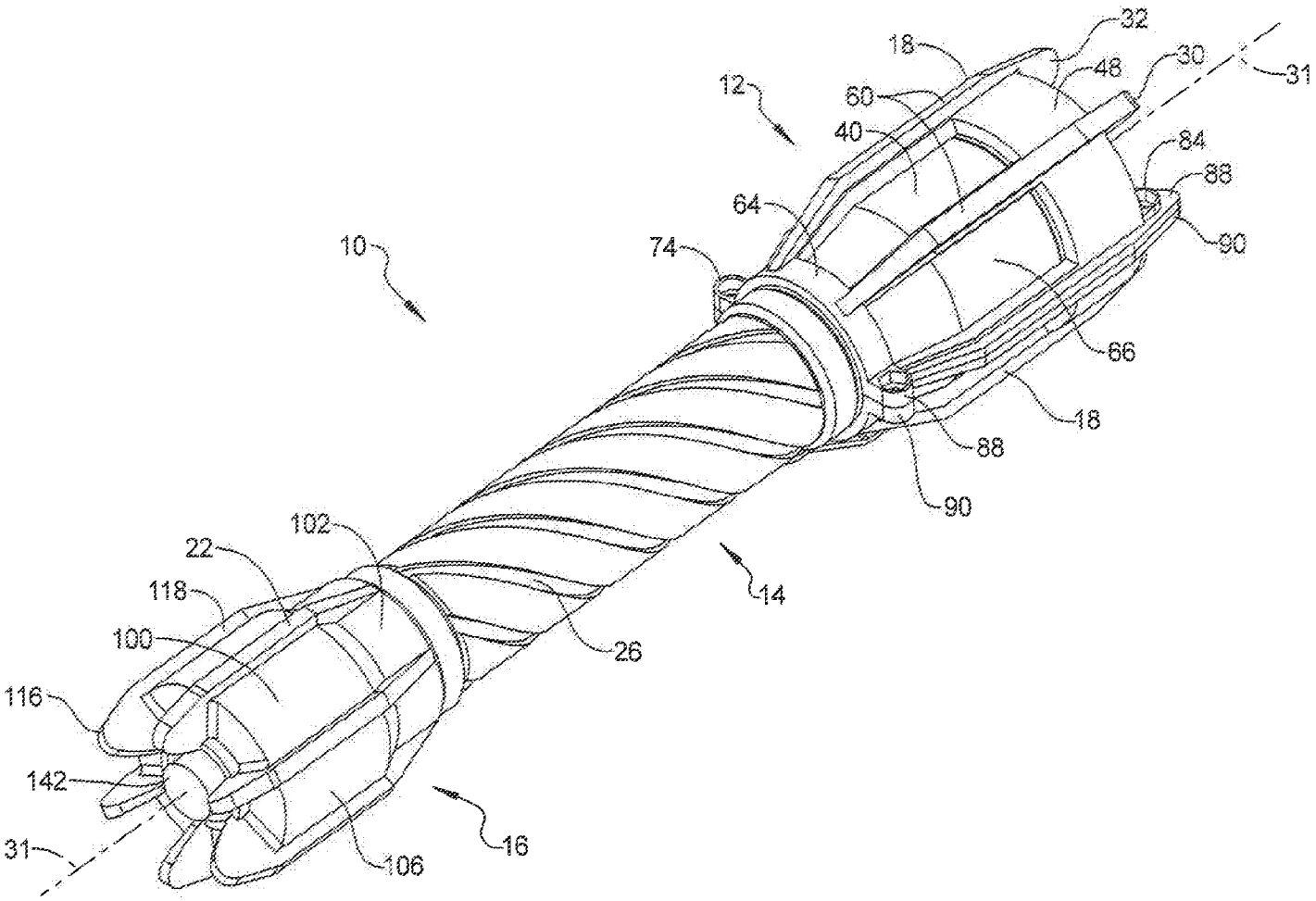
FIG. 1 is a rear perspective view of a representative embodiment of a flashlight fitted with front and rear shock absorbers.

As shown in FIG. 1, a flashlight 10 includes a front portion 12, a central portion 14 and a rear portion 16. A front shock absorber 18 is provided on the front portion 12 and a rear shock absorber 22 is provided on the rear portion 16. The central portion 14 extends between the front and rear portions and can include a grooved outer gripping surface, such as a spiral grooved portion 26 which can be provided as a sleeve or plastic molded portion over an underlying tubular body 28.

The front shock absorber 18 and the rear shock absorber 22 can be formed of a flexible, elastic resilient material for absorbing shock and impact forces applied to the flashlight 10. In one embodiment, the front and rear shock absorbers 18, 22 can be homogeneously molded or otherwise formed from a rubber or plastic material. Nylon and high density polyethylene plastics has been found to be well suited for this application. As seen in FIG. 1, the front shock absorber 8 forms a protective open cage structure around the front portion 12 of the flashlight 10.

The flashlight 10 has a central axis 31 from which axial and radial directions are referenced. As further shown in FIGS. 1 and 2, the front shock absorber 18 includes a series of circumferentially-spaced-apart bumpers in the form of axially-forwardly projecting thin-walled fingers or fins 30. Each fin 30 can include a base portion 32 extending axially upwardly from a bottom wall portion 34 to an arched apex or tip portion 35. A radially inwardly and axially-rearwardly sloping edge 37 can extend from the tip portion 35 to the bottom wall portion 34. Bottom wall portion 34 can be formed as an annular radial flange 36 forming a circular aperture over the front portion 12. The circular aperture provides an opening for the passage of illuminating light from within the front portion 12.

The bottom wall portion 34 extends radially inwardly above an upper leading edge 38 on a front crown portion 40 of the flashlight 10. A clearance space 44 can be provided between the bottom of the radial flange 36 and the upper edge 38 of the crown portion 40. The crown portion 40 may be formed of a rigid plastic or metal material. However, an aluminum material has been found to be well suited for this function due to its ability to conduct heat efficiently from the crown portion 40 to ambient so as to avoid undesirably high temperatures in the crown portion 40.

The clearance space 44 can extend axially over a distance 46 from about one tenth of a millimeter to several millimeters. The cylindrical clearance space 44 provides a crush zone or safety zone over which the fins 30 can axially deflect rearwardly and inwardly upon receiving an axial or radial impact force. That is, the resilient bending of the fins 30 absorbs and dissipates a significant amount of kinetic energy before making contact, if any, with the crown portion 40 of the flashlight 10. This provides significant protection to the flashlight.

Figure 2:
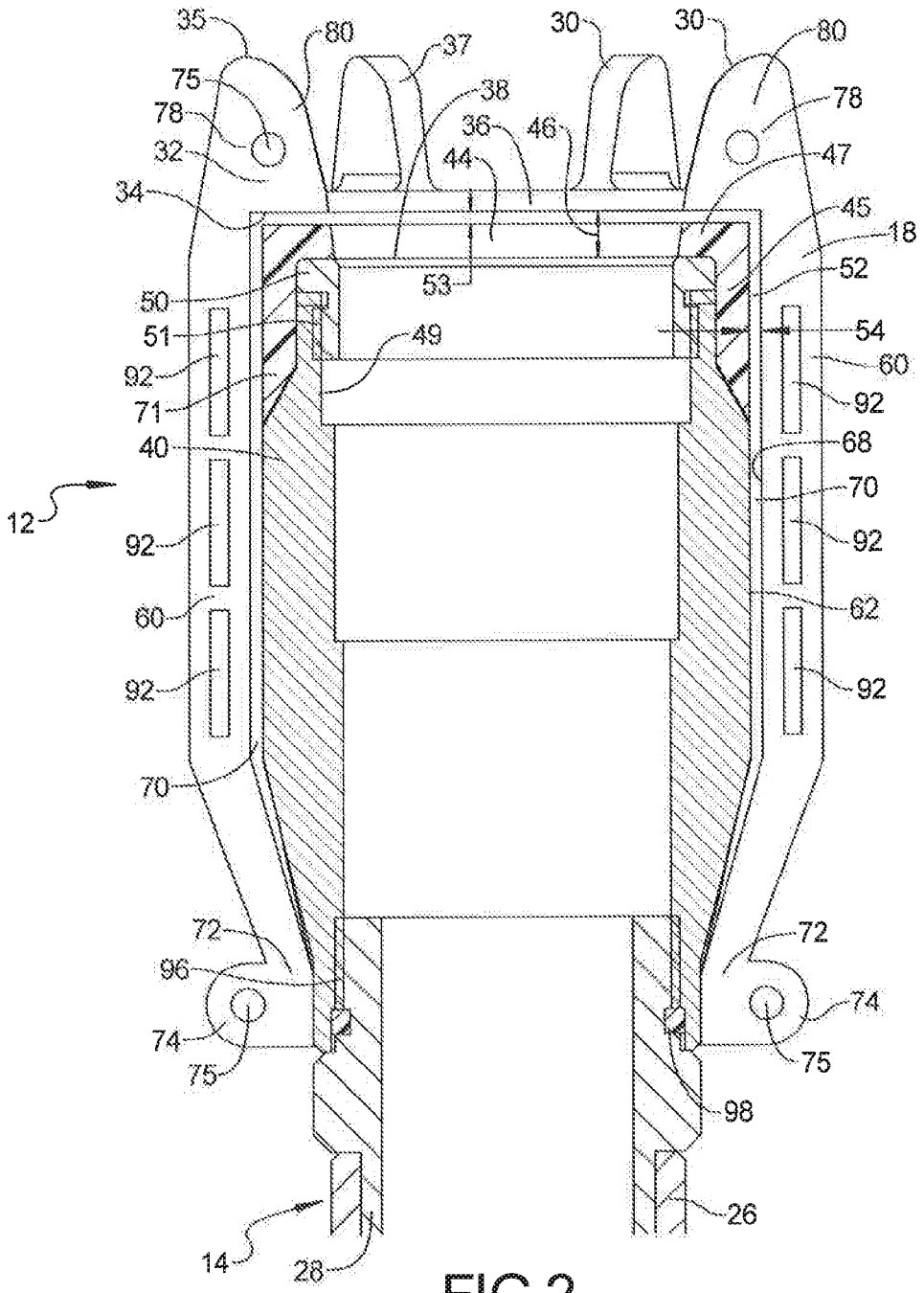
FIG. 2 is a central axially-sectioned view of the front portion of the flashlight of FIG. 1.

In the embodiment of FIG. 2, a soft resilient rubber, elastomeric or spongy annular bezel cap 45 can be provided around and over the upper edge 38 of the front crown portion 40. Cap 45 can be molded from silicone rubber directly on the crown portion 40 or applied as a coating or stretchable sleeve over the crown portion 40. Localized forces applied to the front shock absorber 18 are transferred to and absorbed and spread out through the cap 45 over a larger surface area of the front portion 12 by compression of the cap 45 caused by the deflection of shock absorber 18.

The cap 45 can include an annular radial lip 47 extending radially over a flashlight lens retainer sleeve 50 which is press fit or threaded into the front crown portion 40 along interface 51. The lens retainer sleeve 50 secures a lens (not shown) within a lens mounting groove 49. A small axial clearance 53 can be provided between the top surface of the cap 45 and the bottom wall portion 34. Alternatively, the axial clearance can be eliminated and the bottom wall portion 34 can engage the cap 45 with a light elastic compression fit.

It should be noted that even if only one or two fins 30 are forcefully impacted, the impact force is distributed circumferentially through the annular radial flange 36 all the way around and through the front shock absorber 18. That is, a cylindrical front band 48 (FIG. 1) extends axially rearwardly or downwardly from the radial flange 36 and receives impact forces transmitted from the fins 30 and the radial flange 36.

Figure 8:
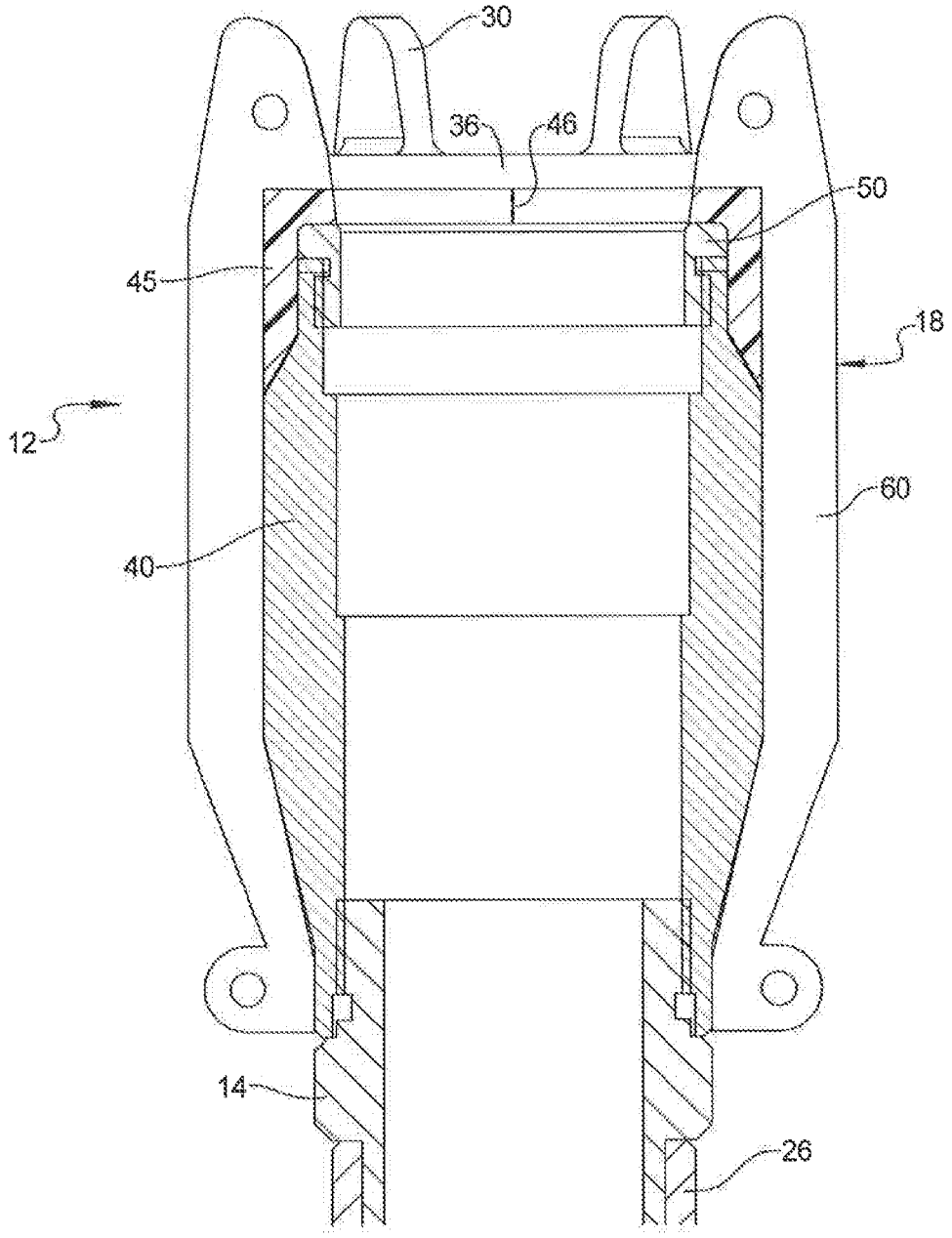
FIG. 8 is a view similar to FIG. 2 showing the ribs of the front shock absorber in direct contact with the outer surface of the front portion of the flashlight.

As further seen in FIG. 2, the front band 48 (FIG. 1) can be dimensioned to surround the crown portion 40 of the flashlight 10 with an annular or cylindrical radial clearance space 52. This establishes a radial crush zone or safety zone around the outside of the crown portion 40 through which the front band 48 will deflect and absorb impact energy from the fins 30 and/or directly from impact with the front band 48. The radial clearance space 52 can extend radially from about one millimeter to about one centimeter between the crown portion 40 and the front band 48, as indicated by spacing arrows 54. In an alternate embodiment, the front band 48 can make contact with and radially embrace the crown portion 40 without a clearance space 52, such as shown in FIG. 8.

Additional shock absorption and impact protection is provided around the front portion 12 of the flashlight 10 by a circumferentially spaced apart series of ribs 60. Each rib 60 can extend axially rearwardly from the base portion 32 of each fin 30 to a rear cylindrical band 64 (FIG. 1). Large open spaces 66 are provided between each pair of adjacent ribs and the front and rear bands 48, 64. In the example shown in FIG. 1, the open spaces 66 completely surround the front portion 12 and expose more than about half and preferably up to about 90 percent of the outer surface area of the front portion 12.

The open spaces 66 allow for direct contact between the surrounding ambient air and the outer surface of the front portion 12 of the flashlight 10. Advantageously, more than half of the surface area of the front portion 12 is exposed by the open spaces 66 allowing for effective convective cooling around the front portion 12. Stated otherwise, more than half of the envelope of the front shock absorber is open to ambient when mounted on the front portion 12 of the flashlight 10. This helps to prevent excessive heating of the front crown portion 40.

As further seen in FIG. 2, an annular or cylindrical clearance space 70 can be maintained between the radially inner surfaces 68 of the ribs 60 and the outer surface 62 of the front portion 12 of the flashlight 10. As described above with respect to the radial clearance space 52, clearance space 70 provides a radial crush zone or safety zone through which the ribs 60 can resiliently radially deflect and dissipate impact energy before contacting the outer surface 62 of the front portion 12. In an alternate embodiment, the ribs 60 can make contact with and embrace the front portion 12 of the flashlight 10 without a clearance space.

In yet another embodiment, the soft rubbery annular cap 45 can be formed with elongated tubular sidewalls 71 that extend axially over substantially the entire length of the front crown portion 40 so as to fill the radial clearance spaces 52,70 with energy absorbing resilient material, such as silicone rubber. The tubular sidewalls 71 can be provided separately from the cap 45 as a molded elastic sleeve. In either case, the tubular sidewalls 71 allow for the inward radial deflection of the ribs 60, while providing additional shock absorption and distribution of impact forces.

The bottom portions 72 of a pair of diametrically opposed ribs 60 can be provided with connectors 74 for mounting the front shock absorber 18 on the front portion 12 of the flashlight 10. Similar connectors 78 can be provided on the top portions 80 of these ribs or on the fins 30 as shown. The connectors 74 can be formed as flanges with simple through holes 75 through which a fastener 84 extends.

In the embodiment shown in FIGS. 1 and 2, the front shock absorber 18 is formed as a pair of homogeneously molded mirror image half shells 88, 90. The half shells 88, 90 are anchored or clamped around the lower end of the front portion 12 of the flashlight 10 via the connectors 74, 78. A threaded fastener, rivet or any other suitable fastener can be used to clamp together and hold the half shells 88, 90 in a securely fixed position on the front portion 12 of the flashlight 10. Other types of connectors can be used to hold the half shells together such as pin and socket connectors, snap fit connectors, dovetail connections and adhesive bonds.

It is also possible to lightly clamp the half shells 88, 90 to the front portion 12 with a light frictional clamping force so that upon impact, the front shock absorber 18 can frictionally rotate around the front portion 12 and thereby dissipate some of the impact force through friction. Alternatively, the front shock absorber can be molded as a single stretchable shell which can be stretched over the front portion 12 in the manner of a sock or molded directly over the front portion 12 as an insert molded assembly.

Additional flexibility, resilience and shock absorption can be provided around the front portion 12 of the flashlight 10 by forming openings in the ribs 60. For example, as seen in FIG. 2, elongated slots 92 allow the ribs 60 to flex radially inwardly so as to compress the slots 92 and absorb additional impact energy. As further shown in FIG. 2, the front portion 12 of the flashlight 10 can be removably secured to the central portion 14 via a threaded interconnection 96. An O-ring 98 is clamped between the front and central portions 12, 14 for sealing against water and other liquids.

Figure 3:
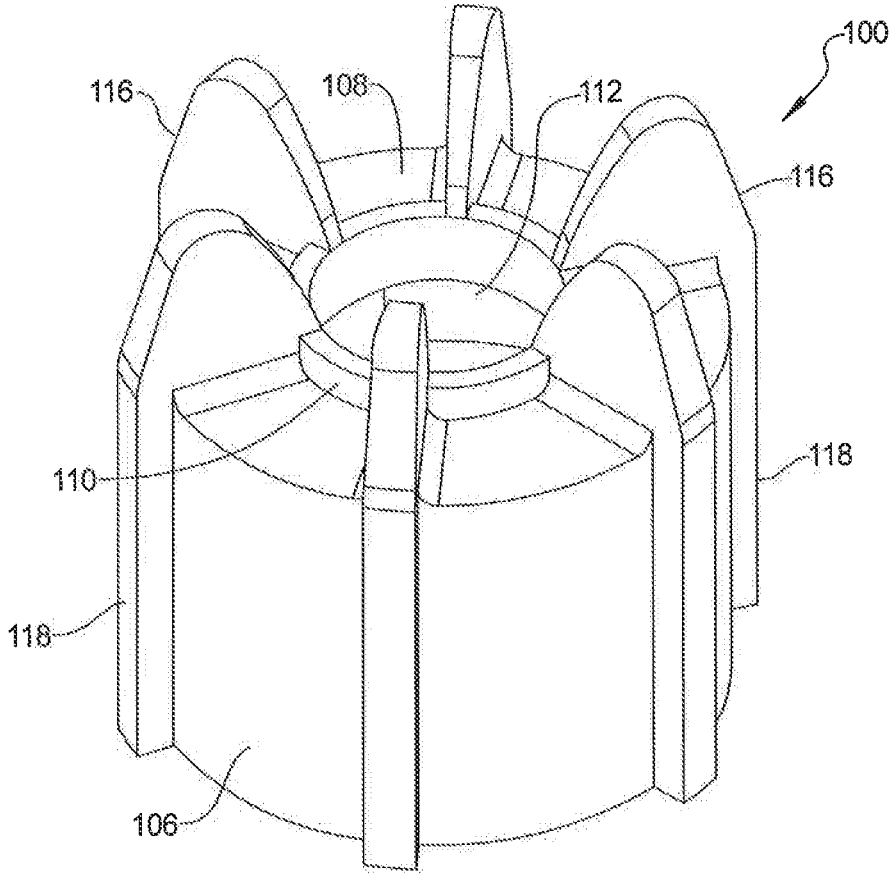
FIG. 3 is a rear end perspective view of the rear end cap of FIG. 1.
Figure 4:
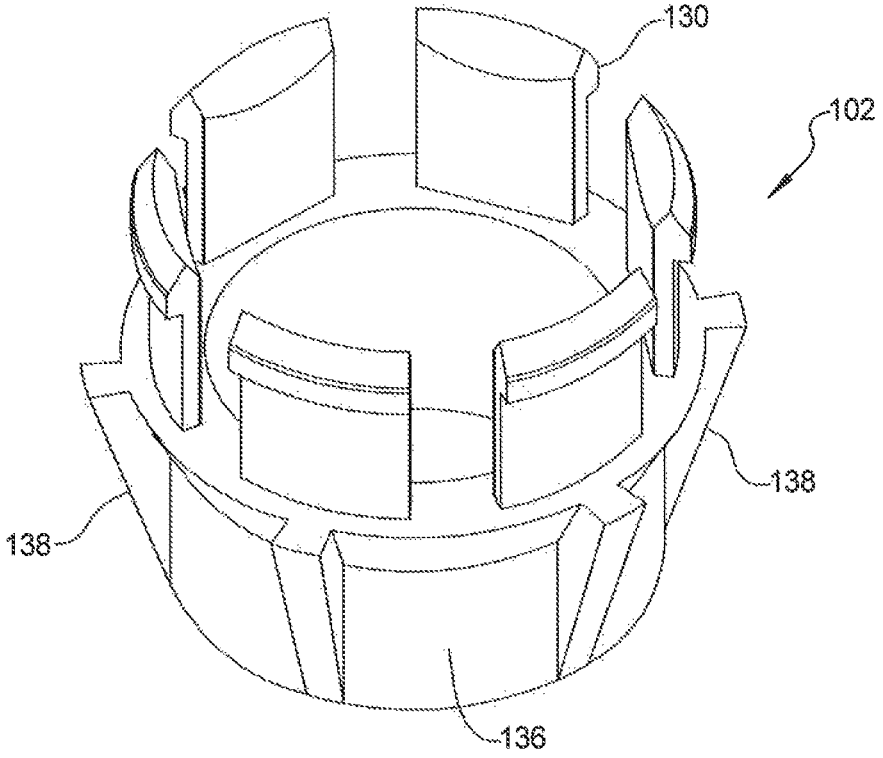
FIG. 4 is a rear perspective view of the locking ring of FIG. 1.

As further seen in FIGS. 1, 3 and 4, the rear shock absorber 22 can include a cup-shaped end cap 100 secured to the rear portion 16 of flashlight 10 with a locking ring 102. The end cap 100 and locking ring 102 can be formed of the same material as the front shock absorber 18. That is, they can be each homogeneously molded of a rubber or plastic material such as nylon plastic.

The end cap 100 includes a cylindrical side wall 106. An annular end wall 108 extends radially inwardly from the rear end of the side wall 106 to an annular axially-extending end flange 110. The end flange 110 encircles a central opening 112 which extends through the end wall 108.

In a manner similar to the front shock absorber 18, a series of radially-rearwardly extending thin walled fins 116 project rearwardly and radially-outwardly from the annular end wall 108 for absorbing impact forces around the rear portion 16 of the flashlight 10. A series of axially and radially extending ribs 118 is formed along the side wall 106 of the end cap 100. The ribs 118 extend rearwardly into the fins 116 for absorbing axial and radial impacts around the rear portion 16 of the flashlight 10.

Figure 5:
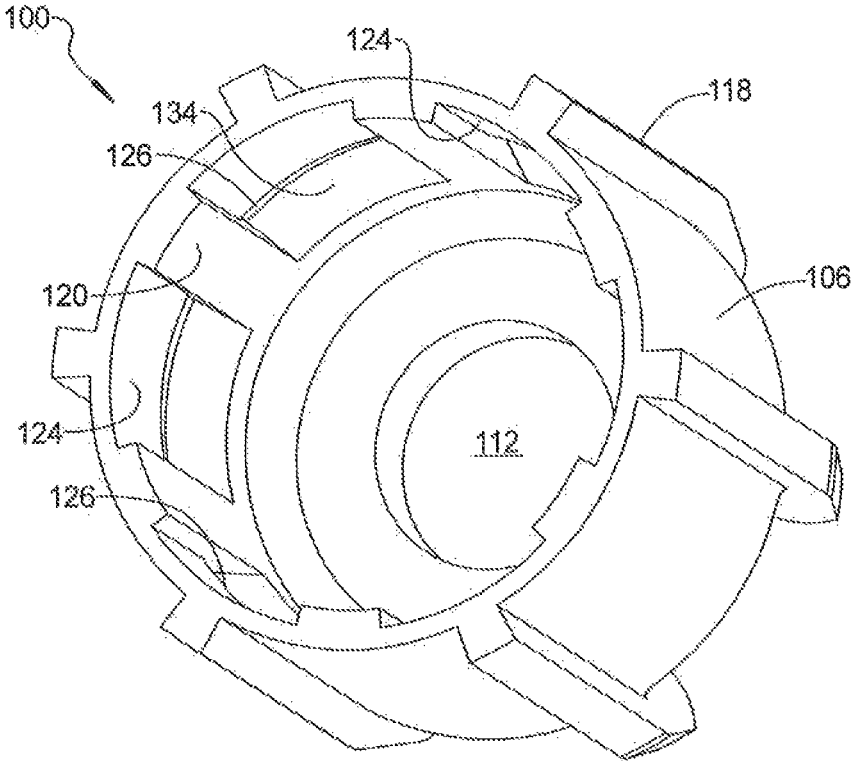
FIG. 5 is a front perspective view of the end cap of FIG. 3.

As shown in FIG. 5, the end cap 100 has an inner side wall 120 formed with a circumferentially-spaced series of radial grooves 124 leading axially into radially undercut ledges 126 for receiving resilient locking hooks 130 (FIG. 4) on the locking ring 102. The locking hooks 130 extend axially into the grooves 124 and snap radially-outwardly over the ledges 126 into the radial undercut pockets 134 adjacent and under the ledges 126.

As further shown in FIG. 4, the locking ring 102 includes a fructoconical side wall 136 having a series of circumferentially-spaced radially-outwardly extending ribs 138. The ribs 138 are arranged to align with and abut the ribs 118 on the end cap 100 when the end cap is fitted over the end portion 16 of the flashlight 10. That is, the end cap 100 is locked onto the rear portion 16 of the flashlight 10 by pushing the end cap 100 axially forwardly so that the grooves 124 align with the locking hooks 130 causing the resilient locking hooks 130 to deflect radially inwardly and then snap radially outwardly into the undercuts 134.

Figure 6:
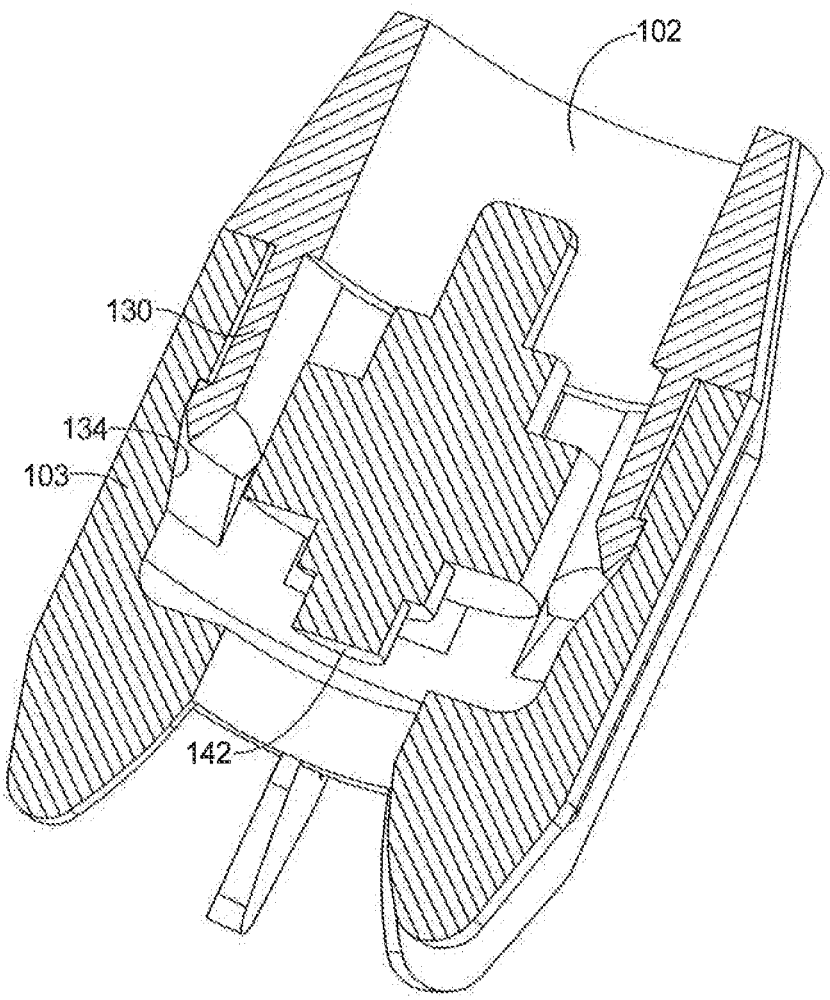
FIG. 6 is a side perspective view in axial section through the center of the rear shock absorber.

The locking ring 102 can be located on the rear end portion 16 of the flashlight 10 by unscrewing or otherwise removing the front portion 12 from the central portion 14 and sliding the locking ring 102 over the central portion 14 until the locking ring engages a radially enlarged abutment surface on the end portion 16. This axial abutment secures the locking ring 102 in place on the rear portion 16 of the flashlight 10. The end cap 100 can then be connected to the locking ring 102 as described above and as further shown in FIG. 6.

Figure 7:
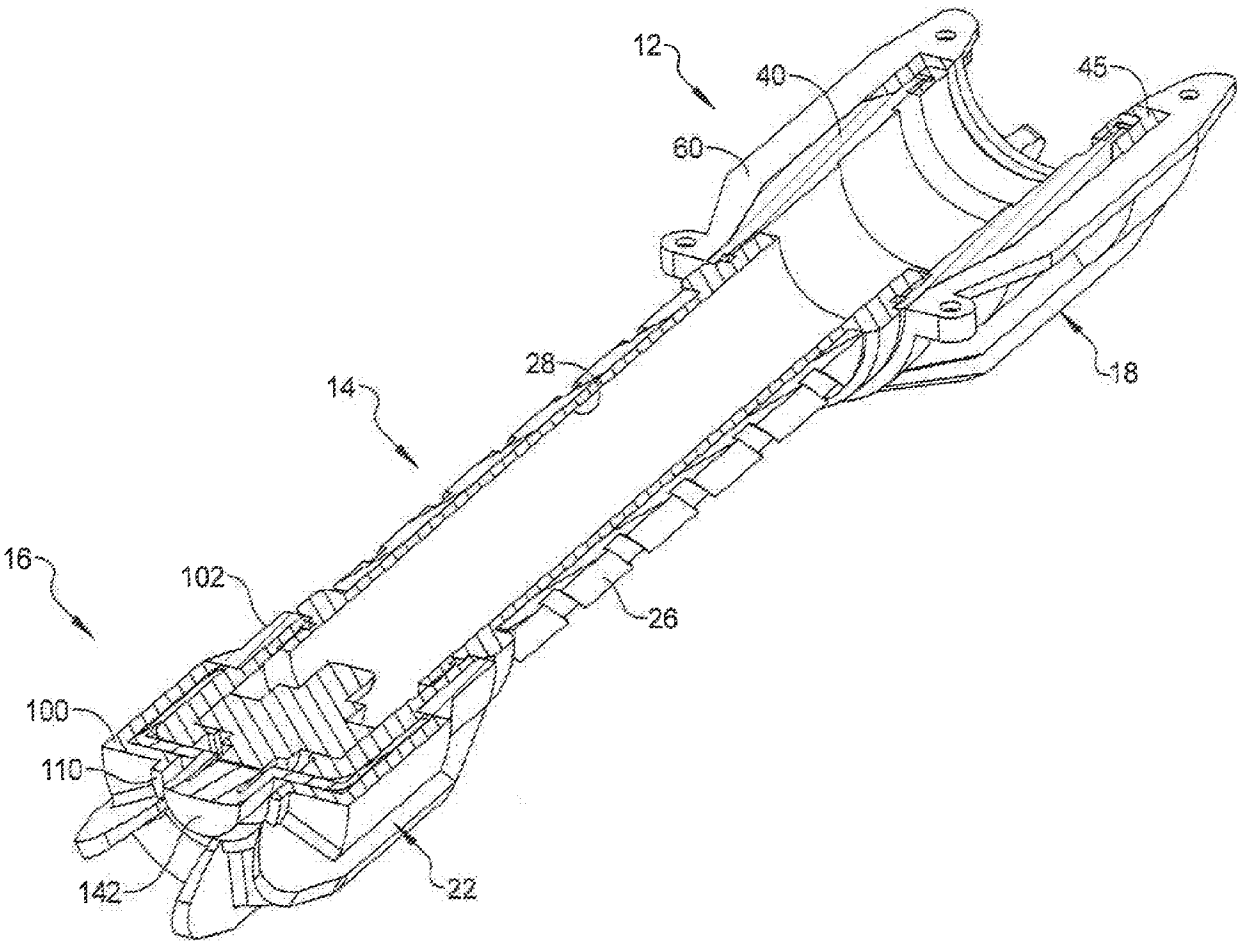
FIG. 7 is a rear perspective view in central axial section of the flashlight of FIG. 1 with a front portion of the flashlight modified as shown in FIG. 8.

Additional structural details of the flashlight 10 and front and rear shock absorbers are shown in FIG. 7 wherein a rubber or plastic switch cover 142 is axially movable through the central opening 112 in the end cap 100 for actuating an on-off switch located within the rear end portion 16 of the flashlight 10.

It should be noted that any or all of the shock absorbing resilient material which is directly carried on the surface of the flashlight 10 including the front and rear shock absorbers 18, 22, the bezel cap 45 and any tubular extension thereof and the spiral grooved portion 26 can be molded onto the flashlight 10 such as by conventional insert molding. Alternatively the front shock absorber 18 can be mounted as described above over an insert molded subassembly with the tubular sleeve 71 molded over the crown portion 40 as described above or applied as an additional insert molded part over the subassembly as a second "shot" or molding in a two shot injection mold or in a separate injection mold.

In yet another embodiment, the front and rear shock absorbers 18,22 can be molded directly to the flashlight 10 by insert molding with or without any intervening softer shock absorbing material provided therebetween.

The embodiment of FIG. 8 is similar to that of FIGS. 1 and 2, but eliminates the axial and radial clearances or crush spaces 53, 54 and the slots 92.

It will be appreciated by those skilled in the art that the above shock absorbing flashlight is merely representative of the many possible embodiments of the disclosure and that the scope of the disclosure should not be limited thereto.

What is claimed is:

1. A flashlight having a central axis, comprising:

a front portion having a crown portion with a leading edge and axially-extending surface portions;

a rear portion;

a central portion extending between said front and rear portions; and a front shock absorber having a protective open structure provided on said crown portion and comprising a series of fins projecting axially forwardly from said front portion and a series of axially-extending ribs projecting radially outwardly from said front portion, said front shock absorber having open spaces formed therethrough and therebetween located axially rearwardly of said leading edge, said open spaces exposing said axially-extending surface portions of said crown portion and allowing ambient air to contact and cool said front portion.

2. The flashlight of claim 1, wherein said series of ribs extends axially forwardly into said series of fins.

3. The flashlight of claim 1, wherein said front shock absorber further comprises a front band surrounding said front portion of said flashlight and wherein said series of ribs extends axially and radially from said front band.

4. The flashlight of claim 3, wherein said front shock absorber further comprises a rear band surrounding said front portion, and wherein said open spaces extend axially between said front and rear bands.

5. The flashlight of claim 1, wherein said front shock absorber is molded around said front portion.

6. The flashlight of claim 5, wherein said crown portion is formed of metal to efficiently conduct heat to ambient.

7. The flashlight of claim 1, wherein said protective open structure comprises a cage structure surrounding said front portion.

8. The flashlight of claim 1, wherein said front shock absorber is formed of a resilient plastic material.

9. The flashlight of claim 1, further comprising a rear shock absorber provided on said rear portion and having a radially extending end wall and a series of fins projecting axially rearwardly from said end wall.

10. The flashlight of claim 1, wherein said open spaces are respectively located between each pair of adjacent ribs in said series of axially-extending ribs.

11. The flashlight of claim 1, wherein said front portion is formed of metal and said shock absorber is formed of plastic.

12. A shock absorber for a flashlight, said flashlight having a central axis and comprising a plastic molding having a front band, a rear band axially spaced from said front band, a series of axially-extending circumferentially spaced apart ribs and a series of open spaces between said front and rear bands and between adjacent pairs of said ribs, said series of open spaces formed through said plastic molding allowing air to pass therethrough.

13. The shock absorber of claim 12, further comprising a series of circumferentially spaced apart fins formed on said plastic molding.

14. The shock absorber of claim 13, wherein said series of fins is formed with radially inwardly sloping end surfaces.

15. The shock absorber of claim 12, wherein said series of ribs is molded together homogeneously with said front and rear bands.

* * * * *